United States Patent [19]

Kanno

[11] Patent Number: 4,788,014

[45] Date of Patent: Nov. 29, 1988

[54] AUTO-CHOKE DEVICE

[75] Inventor: Isao Kanno, Hamamatsu, Japan

[73] Assignee: Sanshin Kogyo Kabushiki Kaisha, Hamamatsu, Japan

[21] Appl. No.: 55,453

[22] Filed: May 28, 1987

[30] Foreign Application Priority Data

May 28, 1986 [JP] Japan ..... 61-121235

[51] Int. Cl.[4] ..... F02M 1/10

[52] U.S. Cl. ..... 261/39.2; 261/64.6

[58] Field of Search ..... 261/39.2, 64.6

[56] References Cited

U.S. PATENT DOCUMENTS

| | | | |
|---|---|---|---|
| 2,571,602 | 10/1951 | Neuser | 261/64.6 |
| 2,764,393 | 9/1956 | Geyer | 261/64.6 |
| 2,774,343 | 12/1956 | Schaffer et al. | 261/39.2 |
| 2,783,984 | 3/1957 | Kramer | 261/64.6 |
| 3,291,462 | 12/1966 | Mennesson | 261/39.2 |
| 3,928,511 | 12/1975 | Atsumi et al. | 261/64.6 |
| 3,968,189 | 7/1976 | Bier | 261/39.2 |
| 4,351,782 | 9/1982 | Bellicardi et al. | 261/39.2 |
| 4,439,377 | 3/1984 | Nartowski | 261/64.6 |

FOREIGN PATENT DOCUMENTS

| | | | |
|---|---|---|---|
| 52-39037 | 3/1977 | Japan | 261/39.2 |
| 54-20238 | 2/1979 | Japan | 261/64.6 |

*Primary Examiner*—Tim Miles

*Attorney, Agent, or Firm*—Ernest A. Beutler

[57] ABSTRACT

Two embodiments of choke mechanisms for internal combustion engines such as those of outboard motors embodying an automatic actuator for positioning the choke valve in reponse to temperature variations and a mechanical actuator for permitting manual operation of the choke valve between its positions.

10 Claims, 4 Drawing Sheets

AUTO-CHOKE DEVICE

BACKGROUND OF THE INVENTION

This invention relates to an auto choke device for an internal combustion engine and more particularly to an improved automatic choke device having a manual override that is particularly adapted for use with engines used in outboard motors or the like.

Typically engines incorporate some form of cold starting and cold running enrichment mechanism in their induction system for providing enrichment for starting and running under these conditions. One typical form of enrichment device comprises a choke valve that is positioned in the induction passage and which is moved to a closed position at low temperatures in order to provide enrichment for starting and running until the engine warms up. It is typically the practice to employ an automatic operator for the choke valve so that it will be automatically positioned in response to temperature variations so as to avoid the necessity for operator control. One form of automatic choke operator incorporates a biasing spring that will tend to bias the choke valve to one of its positions (either open or closed). A thermally responsive element cooperates with the choke valve and the spring so as to determine the actual choke valve position. Although such automatic operators obviously have a number of advantages, they can present problems when the automatic operator becomes disabled either permanently or temporarily.

Typically an automatic choke mechanism will either fail by holding the choke valve in its fully closed position or in preventing the choke valve from being moved from its fully opened positioned to a closed position. In either instance, starting problems and/or poor fuel economy can result. With previous mechanisms, the operator has had to move to the engine compartment and manually position the choke valve through operating either the linkage or the choke valve itself. As a result, it is required to have another person handy in order to crank the engine or start the engine while the first person holds the choke valve in the desired position. Obviously, this is not at all advantageous.

There have also been provided so called "unloader mechanisms" that permit the operator to hold a stuck choke valve in a partially opened position to facilitate starting. However, these mechanisms have necessitated holding the throttle valve in a fully opened position and this is not always the optimum position for starting. Furthermore, the choke valve may again move to its closed position once the throttle valve is moved away from its fully opened position.

It is, therefore, a principal object of this invention to provide an improved device for manually operating an automatic choke mechanism.

It is another object of this invention to provide an automatic operator for an automatic choke mechanism with a manual override that will permit the choke to function normally in the automatic mode or be positioned manually at the operator's control.

SUMMARY OF THE INVENTION

This invention is adaptedto be embodied in an automatic choke for an internal combustion engine comprising a choke valve movable within an induction passage between an opened position and a closed position. An automatic operator is provided for automatically controlling the position of the choke valve in response to temperature variations and, in accordance with the invention, a manual actuator is operatively connected to the choke valve for operating the choke valve manually.

DETAILED DESCRIPTION OF THE PREFERRED EMBODIMENTS OF THE INVENTION

Embodiment of FIGS. 1–4

Figure 1:
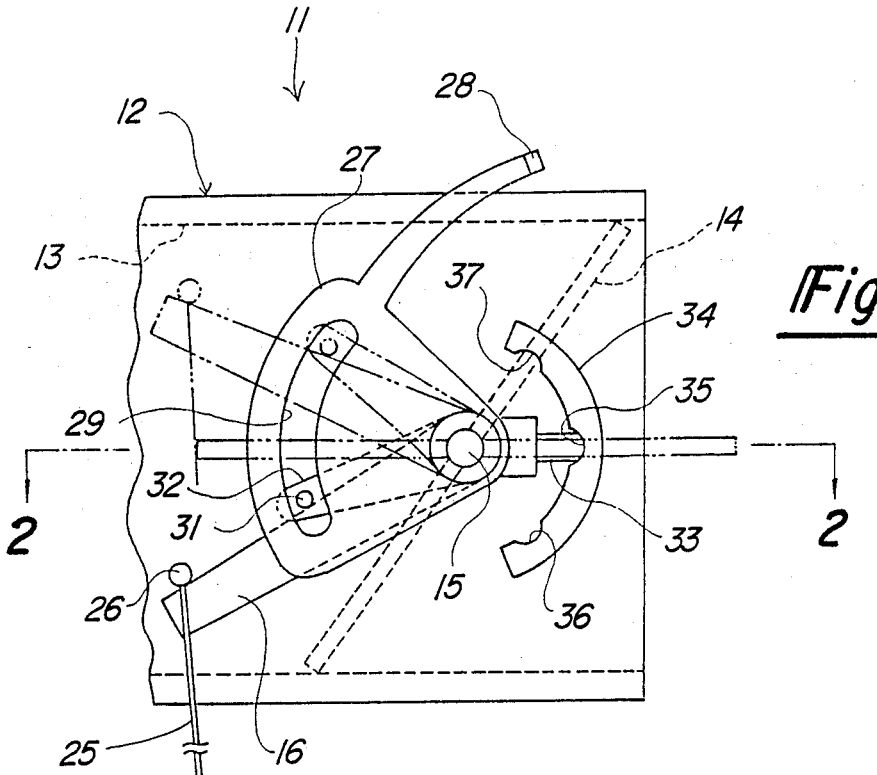
FIG. 1 is a side elevational view of a choke valve having an actuator constructed in accordance with a first embodiment of the invention wherein the closed or choke position of the valve is indicated in broken lines and the opened position of the choke valve is shown in dot-dash lines.
Figure 2:
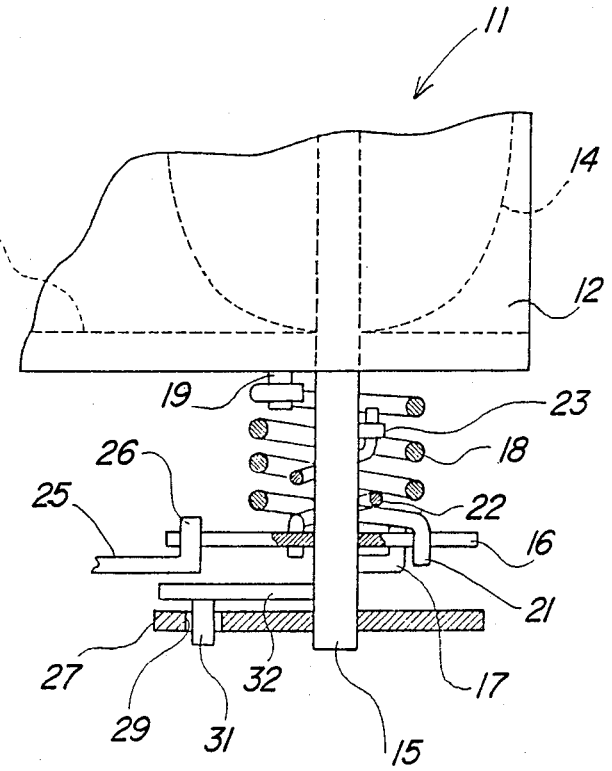
FIG. 2 is an enlarged cross sectional view taken along the line 2—2 of FIG. 1.

A charge forming device such as a carburetor constructed in accordance with a first embodiment of the invention is illustrated partially in the drawings and is identified generally by the reference numeral 11. The carburetor 11 may be associated with an internal combustion engine of any known type such as the engine of an outboard motor. Since the invention relates primarily to the choke valve and its operating mechanism only this portion of the carburetor 11 has been shown in detail.

The carburetor 11 includes an air inlet body portion 12 having an induction opening 13 that receives a source of air which may be filtered and/or silenced from an appropriate inlet device (not shown). A choke valve 14 is rotatably supported in the inlet passage 13 by means including a choke valve shaft 15 that is journaled in the body 12 in an appropriate and known matter.

The choke valve shaft 15 extends outwardly beyond one side of the body portion 12 and a lever 16 is journaled on this end of the choke valve shaft 15. The lever 16 cooperates with an in-turned tang 17 that is affixed to the choke valve shaft 15 for transferring rotary movement from the lever 16 to the choke valve shaft 15 and choke valve 14. To this end, a torsional spring 18 encircles the choke valve shaft 15 and has one of its ends staked to a pin 19 carried by the carburetor body 12. An other end 21 of the torsional spring 18 engages the lever 16 and normally urges it into engagement with the choke valve shaft tang 17 for rotatably urging the choke valve 14 to one of its extreme positions. In the illustrated embodiment, the torsional spring 18 is wound so that it urges the lever 16 and choke valve shaft 15 to the fully opened position of the choke valve 14 as shown in the dot-dash line view of FIG. 1 and in the solid-line view of FIG. 4.

A further torsional spring 22 encircles the choke valve shaft 15 and bears against a tang 23 formed on the choke valve shaft 15 and on the opposite side of the lever 16 for urging the choke valve shaft 15 in a direction which will follow the counterclockwise rotation of the lever 16 for moving the choke valve 14 to its closed position.

The lever 16 is normally urged in a counterclockwise direction in response to low temperatures by means of a temperature responsive element 24 that is mounted in proximity to a portion of the engine which is indicative to normal engine temperature. The temperature responsive device 24 may comprise an expansible wax pellet that operates a rod 25 which, in turn, has an in-turned end 26 that overlies the lever 16. When the temperature of the engine is low, the rod 25 will be pulled downwardly so as to rotate the lever 16 in a counterclockwise direction. The torsional spring 22 will cause the shaft 15 to rotate in the same direction and the choke valve 14 will then be closed as shown in the broken-line view in FIGS. 1 and 3. When this occurs, the torsional spring 18 will also be wound up by the action of the thermally responsive element 24.

Figure 4:
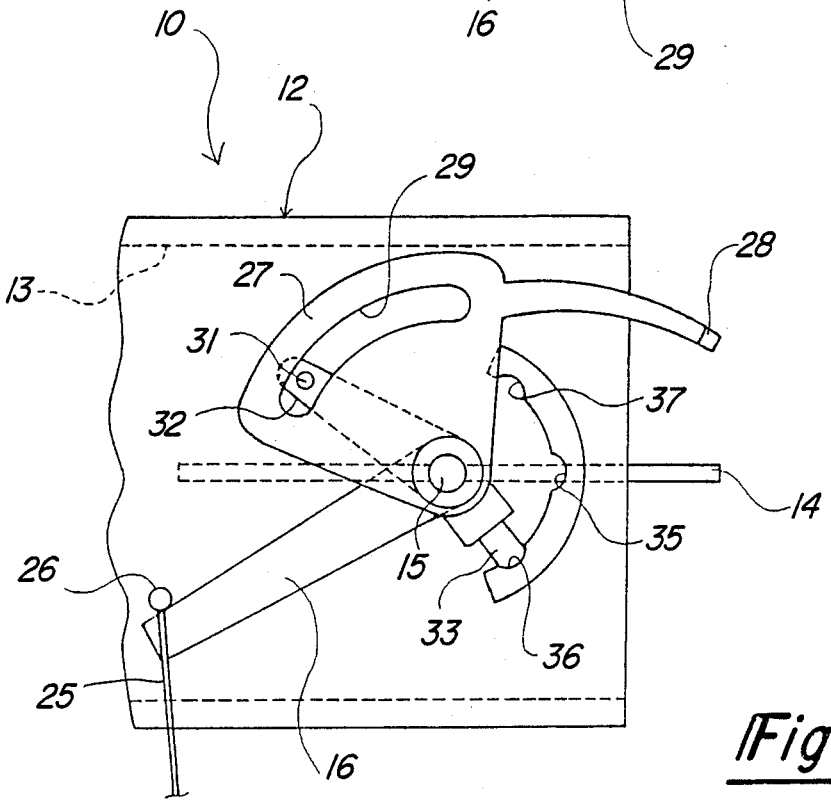
FIG. 4 is a side elevational view, in part similar to FIGS. 1 and 3, showing the manual actuator moved to a position for opening the choke valve in the event of failure.

As the temperature of the engine increases, the rod 25 will expand and the in-turned end 26 will move upwardly so as to permit the lever 16 to rotate in a clockwise direction under the action of the spring 18 so as to open the choke valve 14 to the dot-dash line position as shown in FIG. 1 and the solid-line position as shown in FIG. 4. Under this condition, the spring 22 will not undergo any deflection since both of its ends will rotate uniformly. Hence, it should be clear that the springs 18 and 22 form part of a lost motion connection between the lever 16 and the choke valve shaft 15 and choke valve 14.

In addition to the automatic control as thus far described, there is also provided a manual control for permitting the operator to selectively move the choke valve 14 from its opened position to its closed position or from its closed position to its opened position. This manual control comprises a manually operable lever 27 that is rotatably journaled on the outer end of the exposed choke valve shaft 15. The lever 27 has an outturned tang 28 that affords a portion that can be gripped by the operator so as to facilitate rotation of the lever 27. The lever 27 is formed with an arcuate slot 29 into which a pin 31 extends. The pin 31 is affixed to a lever 32 that is affixed to the choke valve shaft 15. The lever 32 has a detent mechanism comprised of a spring biased detent member 33 that is adapted to cooperate with a fixed plate 34 that is carried by the carburetor body 12. The plate 34 has a first, normal automatic choke operation recess 35, a choke opening recess 36, and a choke closing recess 37 which are angularly spaced as may be readily apparent in FIGS. 1, 3 and 4.

When the lever 32 is in the normal choke operation position so that the detent 33 is within the recess 35 (FIG. 1) the arcuate slot 29 is disposed so that the lever 32 and choke valve shaft 15 may rotate freely between the fully closed and fully opened positions without interference. When the detent 33 is in the choke closing recess 37 (FIG. 3) the choke valve 14 will be held in a fully closed position and the choke valve 14 cannot be opened by the action of the spring 18. When the detent 37 is in the choke opening recess 36 (FIG. 4) the relationship of the slot 29 is such that the choke valve 14 will be held in its fully opened position and the automatic choke operating mechanism cannot move the choke valve 14 to its fully closed position.

Figure 3:
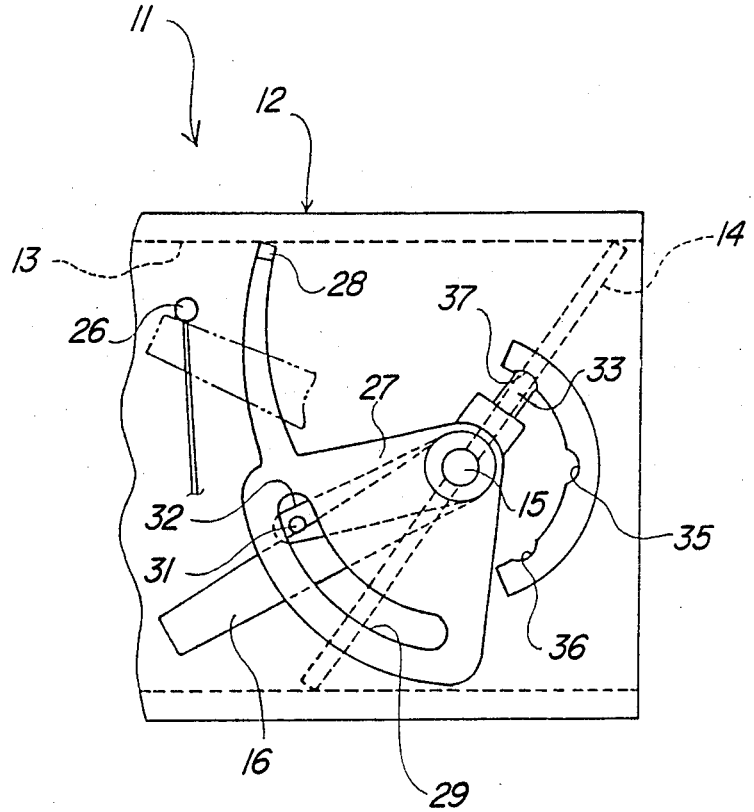
FIG. 3 is a side elevational view, in part similar to FIG. 1, showing the manual actuator moved to a position for achieving closing of the choke valve in the event of failure of the automatic actuator.

As has been previously noted, the automatic choke operating mechanism is such that the choke valve 14 can be moved between its closed and opened positions by the temperature responsive member 24 cooperating with the springs 18 and 22 when the manual choke lever 27 is in the normal automatic choke operation position of FIG. 1. The detent 33 is in the recess 35 under this condition, as already noted. If, however, the automatic choke mechanism sticks so that the rod 25 and in-turned lever 26 are stuck in the choke open position as shown in FIG. 3, the choke mechanism 14 may be manually closed. To do this, the operator rotates the lever 27 in a counterclockwise direction from the position shown in FIG. 1 to the position shown in FIG. 3. The detent 33 will snap out of the recess 35 and into the recess 37 under such rotation. When this occurs, the slot 29 will traverse the pin 31 and then its one end will contactthep in 31 so as to rotate the lever 32 and choke valve shaft 15 in a counterclockwise direction to rotate the choke valve 14 to its fully closed or choke position. When this occurs, the tang 17 will urge the lever 16 to rotate in the same direction and will compress the spring 18 so that the lever 16 will move away from the in-turned end 26 of the rod 25.

If the automatic choke operating mechanism becomes stuck in the fully choked position, an operator may open the choke valve 14 if he desires by rotating the lever 27 in a clockwise direction from the position shown in FIG. 1 to the position shown in FIG. 4. When this happens, the slot 29 will traverse the pin 31 and engage its end to rotate the choke valve 14 in a clockwise direction to open it. This is accomplished by moving the detent 33 from the recess 35 to the recess 36. When this occurs, the lever 16 will be held in the fully choked position and the shaft 15 can rotate so as to cause the choke valve 14 and choke valve shaft 15 to be rotated in a clockwise direction. When this occurs, the torsional spring 22 will wind up while the torsional spring 18 will not be unloaded because it will still be maintained in contact with the lever 16 which does not rotate under this condition.

Therefore, it should be readily apparent that this embodiment functions so as to permit normal automatic choke operation but an operator can manually close the choke valve if the automatic mechanism is stuck in the choke opened position or can open the choke valve if the automatic mechanism is stuck in its choke closed position.

Figure 5:
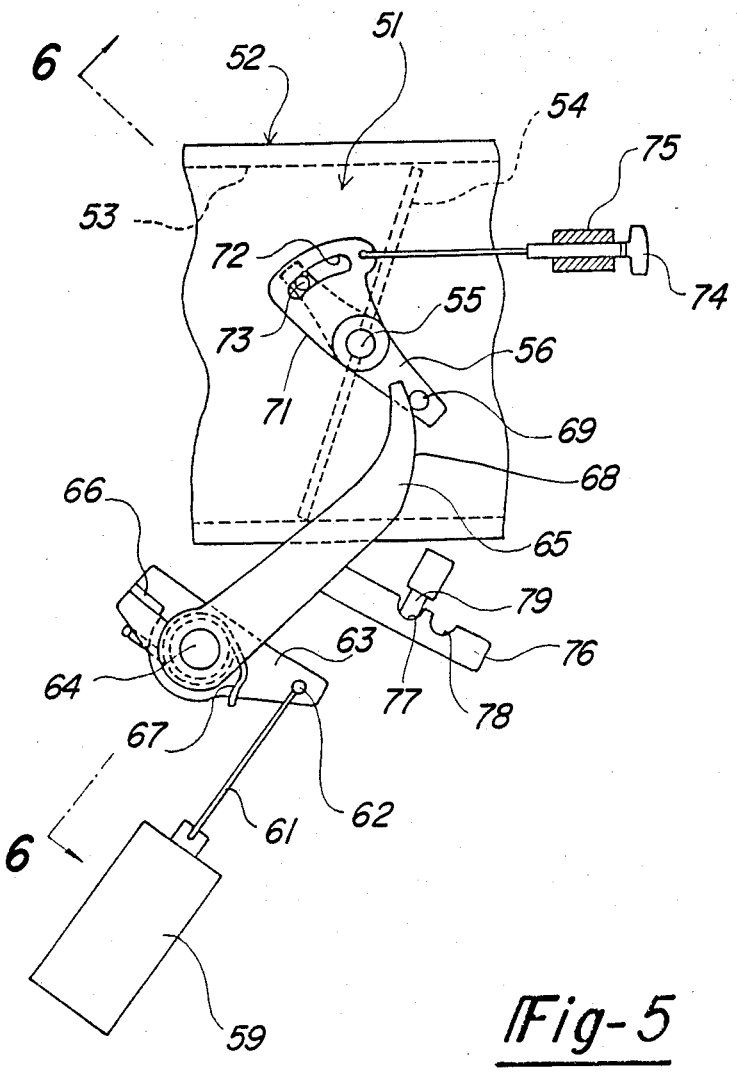
FIG. 5 is a side elevational view of an actuator mechanism for a choke valve constructed in accordance with another embodiment of the invention.
Figure 6:
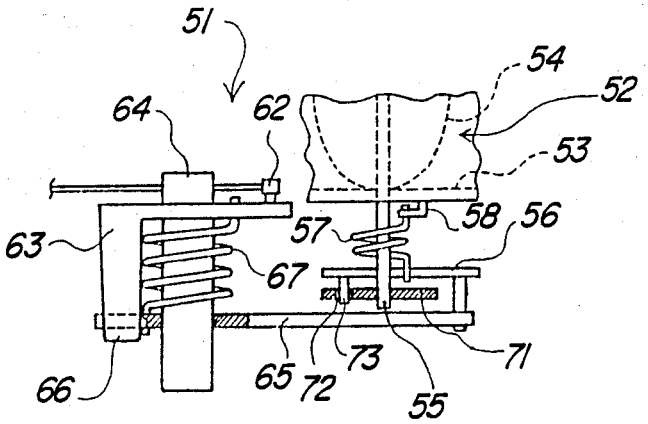
FIG. 6 is an enlarged cross sectional view taken along the line 6—6 of FIG. 5.
Figure 7:
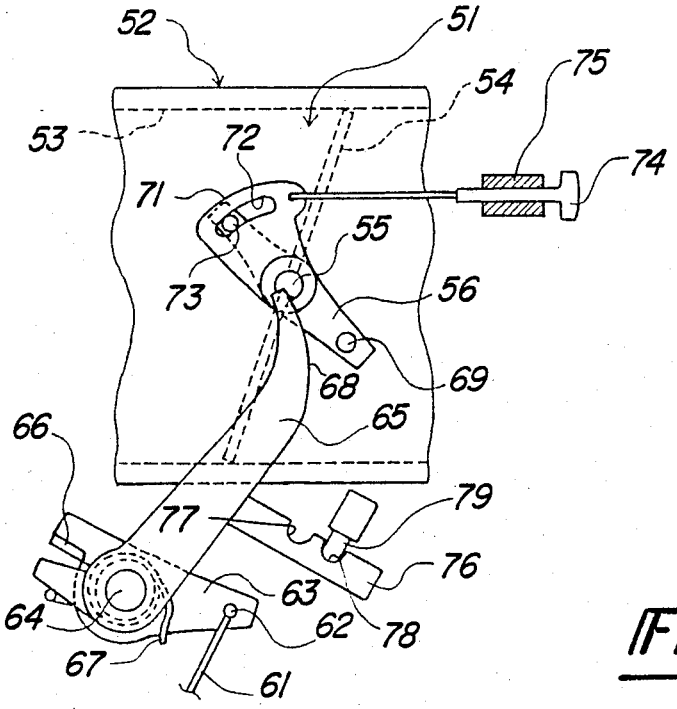
FIG. 7 is a side elevational view, in part similar to FIG. 5, showing the manual actuator in a position for permitting manual opening of the choke valve in the event of failure of the automatic mechanism.

Embodiment of FIGS. 5–7

A charge forming device constructed in accordance with a second embodiment of the invention is identified generally by the reference numeral 51. As with the embodiment of FIGS. 1–4, the invention deals with the choke portion of the carburetor 51 and, for that reasons, only this portion of the carburetor has been illustrated and will be described. Also, as with the previously described embodiment the carburetor 51 is associated with an internal combustion engine such as the engine which powers an outboard motor.

The carburetor 51 includes a body portion 52 that defines an air inlet opening 53 that receives atmospheric air which may have been filtered and/or silenced by an appropriate air inlet device (not shown). A choke valve 54 is rotatably journaled within the induction passage 53 upon a choke valve shaft 55. The choke valve shaft 55 is rotatably journaled within the body portion 52 and has one side (FIG. 6) which extends outwardly beyond the body portion 52.

A lever 56 is affixed for rotation with this exposed end of the choke shaft 55. A torsional spring 57 has one offset end which engages the lever 56 and its opposite end fixed relative to the carburetor body 52, as at 58, for exerting a rotational force in a clockwise direction on the choke valve shaft 55 as seen in FIGS. 5 and 7, for tending to rotate the choke valve 54 from its fully closed position as shown in the figures toward a fully opened position.

The rotational position of the choke valve 54 under the action of the torsional spring 57 is controlled by means of an automatic choke operating mechanism including a thermally responsive element 59, which may be of the wax pellet type, that is affixed to a portion of the engine that will be representative of its temperature. The thermally responsive element 59 operates a rod 61 which has a pivotal connection, as at 62, to a first lever 63. The lever 63 is journaled upon a shaft 64 that is fixed relative to the engine or carburetor body 52 in juxtaposition and parallel relationship to the choke valve shaft 55. A second lever 65 is affixed for rotation with the shaft 64. The first lever 63 has an offset tang 66 that is normally held in engagement with the lever 65 by means of a torsional spring 67 so as to provide a lost motion connection between the levers 63 and 65. The lever 65 has a curved outwardly extending end portion 68 that is normally engaged by a pin 69 carried at the end of the lever 56 so as to control the position of the lever 56 and, accordingly, the choke valve shaft 55 and choke valve 54.

FIG. 5 shows the normal cold temperature position. In this position, the temperature responsive element 59 has drawn the rod 61 downwardly. As a result, the lever 63 will be rotated in a clockwise direction to load the torsional spring 67 and cause the lever 65 to follow this movement. As a result, the curved end 68 will contact the pin 69 and rotate the lever 56 against the action of the torsional spring 57 in a counterclockwise direction for urging the choke valve 54 to its fully closed position.

As the temperature of the engine and the thermally responsive element 59 increase, the rod 61 will be extended and the lever 63 will rotate in a counterclockwise direction. When this happens, the tang 66 will urge the lever 65 to also rotate in a counterclockwise direction and the curved end 68 will move away from the pin 69. However, the torsional spring 57 will rotate the lever 56 in a clockwise direction and the pin 69 will follow the curved surface 68 so as to position the choke valve 54 in a position that is dependent upon the angular position of the lever 65 and, accordingly, the temperature of the engine and the thermally responsive element 59. This rotation will continue until the engine is at full temperature and the choke valve 54 is in a fully opened position.

When the temperature of the engine decreases because it is shut off and cools, the rotation in the opposite sense will occur and the choke valve 54 will again be closed.

As with the previously described embodiment, a mechanism is also incorporated so as to permit manual operation of the choke valve 54 in the event of some failure of the automatic choke operating mechanism. This manual operating mechanism includes a manually operated lever 71 that is journaled on the choke valve shaft 56 and which is formed with an arcuate slot 72 into which a pin 73 extends. The pin 73 is affixed to the lever 56 so as to form a lost motion connection between the manually operated lever 71 and the choke valve lever 56.

A remotely positioned manual operating handle 74 is slideably supported in a guide 75 and has a pivotal connection to the manual lever 71 for positioning the manual lever in response to an operator command.

A mechanism is also provided for blocking out the lever 65 of the automatic choke operating mechanism. This blocking mechanism includes a slideably supported rod 76 that has a pair of detent notches 77 and 78 that are adapted to receive a spring urged detent member 79. When the detent member 79 is in the notch 77 (FIG. 5) the lever 65 may pivot to the fully closed choke valve position as shown in this figure. Under this condition, the device operates automatically. In order to achieve manual operation, however, the bar 76 is pushed to the left as seen in FIGS. 5 and 7 to the position shown in FIG. 7 wherein the detent 79 snaps into the notch 78 and holds the lever 65 in a pivoted position that corresponds to the fully opened position of the choke valve 54. If the temperature of the engine is low and/or the temperature responsive element 59 fails in a low temperature position, the lever 63 will be held in its cold temperature position and the torsional spring 67 will yield so as to permit counterclockwise rotation of the lever 65 relative to the lever 63. The choke valve may be manually opened under this condition by the operator pulling on the handle 74 and rotating the lever 71 in a clockwise direction. The slot 72 will traverse the pin 73 and engage it to rotate it into a fully opened position or such opened position as the operator selects.

In the event the automatic choke mechanism fails in the open position, the choke valve 54 may be closed by the operator urging the handle 74 to the left as seen in FIG. 7 under which case the pin 73 which will be at the opposite end of the slot 72 will be engaged by the lever 71 and rotated to close the choke valve to the position shown in FIG. 7. The guide 75 cooperates with the handle 74 to retain it in the operator selected position either by friction or through a detent mechanism (not shown).

It should be readily apparent from the foregoing description that two embodiments of choke constructions have been described in which both automatic and manual control are accomplished without necessitating the operator disassembling the mechanism or having to hold a portion of the linkage in position. Although two embodiments of the invention have been illustrated and described, various changes in modifications may be made without departing from the spirit and scope of the invention, as defined by the appended claims.

What is claimed is:

1. In an automatic choke for an internal combustion engine comprising a choke valve movable within an induction passage between an opened position and a closed position, biasing means for urging said choke valve to its opened position, an automatic actuator for applying a biasing force upon said choke valve in response to temperature variations for moving said choke valve to its closed position in opposition to the action of said biasing means, and a manual actuator operatively connected to said choke valve for operating said choke valve.

2. An automatic choke for an internal combustion engine defined in claim 1 wherein the manual actuator is connected to the choke valve by means including a lost motion connection for permitting free movement of the choke valve between its opened position and its closed position under the operation of the automatic actuator.

3. An automatic choke for an internal combustion engine defined in claim 1 wherein the automatic actuator has a lost motion connection to the choke valve for permitting movement of the choke valve from its closed position to its opened position under the control of the manual actuator without necessitating movement of the automatic actuator.

4. An automatic choke for an internal combustion engine defined in claim 1 wherein the manual actuator is connected to the choke valve by means including a lost motion connection for permitting free movement of the choke valve between an opened position and a closed position under the operation of the automatic actuator.

5. An automatic choke for an internal combustion engine comprising a choke valve movable within a induction passage between an opened position and a closed position, biasing means for urging said choke valve to one of said positions, an automatic actuator for applying a biasing force upon said choke valve in response to temperature variations for moving said choke valve to the other of its positions in opposition to the action of said biasing means, and a manual actuator operatively connected to said choke valve for operating said choke valve comprising a pivotally supported lever having a slot receiving a pin affixed for rotation with the choke valve for providing a lost motion connection between said manual actuator and said choke valve, said lever being pivotal through a range of movement wherein said lever will engage said pin for rotating said pin sufficiently to move said choke valve between its positions.

6. An automatic choke for an internal combustion engine defined in claim 5 wherein the automatic actuator comprises a thermally responsive element operatively connected to a first lever for pivoting said first lever in response to temperature variations, a second lever journaled for rotation relative to said first lever, biasing means for normally urging said levers to rotate with each other, and means on said second lever engageable with said choke valve for rotating said choke valve against the operation of the first mentioned biasing means.

7. A selective automatic or manually actuated mechanism for cold enrichment of an internal combustion engine comprising an enrichment valve movable between a normal running position and an enrichment position, a temperature responsive element movable in response to temperature variations between a low temperature position and a normal temperature position, coupling means for coupling said temperature responsive element to said enrichment valve for moving said enrichment valve between its positions in response to movement of said temperature responsive element between its positions, said coupling means being operative between an operative condition wherein said temperature responsive element is coupled to said enrichment valve and a released condition wherein said temperature responsive element and said enrichment valve may each move between their positions without movement of the other, disconnection means for moving said coupling means to said released condition, and manual operating means for manually moving said enrichment valve.

8. A selective automatic or manually actuated mechanism defined in claim 7 wherein the enrichment valve comprises a choke valve of a carburetor.

9. A selective automatic or manually actuated mechanism defined in claim 7 wherein the manually operative means is operatively connected to the enrichment valve by means of a lost motion connection for permitting free movement of the enrichment valve between its positions under the control of said temperature responsive element when said coupling means is in its operative condition.

10. A selective automatic or manually actuated mechanism defined in claim 7 wherein the coupling means comprises biasing spring means for biasing the enrichment valve to one of its positions and abutment means operative between the temperature responsive element and the enrichment valve for moving the enrichment valve in opposition to the operation of said biasing spring means to the other of its positions.

* * * * *